US010216132B2

(12) United States Patent
Borenstain

(10) Patent No.: US 10,216,132 B2
(45) **Date of Patent: *Feb. 26, 2019**

(54) LIQUID ELECTRO-PHOTOGRAPHIC PRINTING

(71) Applicant: HP INDIGO B.V., Amstelveen (NL)

(72) Inventor: Shmuel I. Borenstain, Neve-Daniel (IL)

(73) Assignee: HP INDIGO B.V., Amstelveen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/845,569

(22) Filed: Dec. 18, 2017

(65) Prior Publication Data

US 2018/0107144 A1 Apr. 19, 2018

Related U.S. Application Data

(63) Continuation of application No. 14/915,529, filed as application No. PCT/EP2013/067945 on Aug. 29, 2013, now Pat. No. 9,880,501.

(51) Int. Cl.

| | |
|---|---|
| ***G03G 15/00*** | (2006.01) |
| ***G03G 15/01*** | (2006.01) |
| ***G03G 15/10*** | (2006.01) |

(52) U.S. Cl.

CPC ..... *G03G 15/50* (2013.01); *G03G 15/0152* (2013.01); *G03G 15/10* (2013.01); *G03G 15/0157* (2013.01)

(58) Field of Classification Search

CPC ..... G03G 15/0152; G03G 15/0157; G03G 15/10; G03G 2215/0658; G03G 2215/1676; G03G 2215/168

See application file for complete search history.

(56) References Cited

U.S. PATENT DOCUMENTS

| | | | | |
|---|---|---|---|---|
| 5,519,473 | A | 5/1996 | Morehouse | |
| 5,519,476 | A | 5/1996 | Dalal | |
| 5,561,455 | A * | 10/1996 | Teshigawara | H04N 1/508 347/131 |
| 5,722,017 | A | 2/1998 | Caruthers, Jr. et al. | |
| 5,724,090 | A | 3/1998 | Tanaka et al. | |
| 5,946,533 | A | 8/1999 | Omelchenko et al. | |

(Continued)

FOREIGN PATENT DOCUMENTS

| | | |
|---|---|---|
| JP | 2002123087 | 4/2002 |

OTHER PUBLICATIONS

Grossinger; "Dual Color Development System"; Xerox Disclosure Journal; Xerox Corporation; vol. 13, No. 4; Jul. 1, 1988; XP000005049; Whole Document.

*Primary Examiner* — Sandra Brase
(74) *Attorney, Agent, or Firm* — HP Inc. Patent Department

(57) ABSTRACT

In one example, a printing process includes: forming a first latent image on a photoconductor; applying a first LEP ink to the photoconductor to develop the first latent image into a first ink image; forming a second latent image having a first part on the first ink image and a second part on the photoconductor; and applying a second LEP ink to the first ink image and to the photoconductor to develop the second latent image into a second ink image and form a composite on the photoconductor in which some of the second ink image overlaps some of the first ink image.

20 Claims, 8 Drawing Sheets

(56) References Cited

U.S. PATENT DOCUMENTS

| | | | |
|---|---|---|---|
| 6,002,907 | A | 12/1999 | Berkes |
| 6,097,920 | A | 8/2000 | Hara |
| 6,205,311 | B1 | 3/2001 | Maess |
| 6,352,806 | B1 | 3/2002 | Dalal |
| 6,493,530 | B2 | 12/2002 | Ishii et al. |
| 7,177,571 | B2 | 2/2007 | Sato et al. |
| 2002/0051211 | A1 | 5/2002 | Takahashi et al. |
| 2002/0101493 | A1 | 8/2002 | Tanaka |
| 2003/0211412 | A1 | 11/2003 | Ishii |
| 2006/0067740 | A1 | 3/2006 | Ishii |
| 2008/0240755 | A1 | 10/2008 | Shih |
| 2011/0026991 | A1 | 2/2011 | Izawa |

* cited by examiner

LIQUID ELECTRO-PHOTOGRAPHIC PRINTING

BACKGROUND

Liquid electro-photographic (LEP) printing uses a special kind of ink to form images on paper and other print substrates. LEP ink includes charged polymer particles dispersed in a carrier liquid. The polymer particles are sometimes referred to as toner particles and, accordingly, LEP ink is sometimes called liquid toner. LEP ink usually also includes a charge control agent, called a "charge director", that helps control the magnitude and polarity of the charge on the toner particles. In the LEP printing process, an electrostatic pattern of the desired printed image is formed on a photoconductor. This latent image is developed into a visible image by applying a thin layer of LEP ink to the patterned photoconductor. Charged toner particles in the ink adhere to the electrostatic pattern on the photoconductor. The ink image is transferred from the photoconductor to a heated intermediate transfer member, evaporating much of the carrier liquid to dry the ink film. The semi-solid ink film is then pressed on to the cooler print substrate and "frozen" in place at a nip between the intermediate transfer member and the substrate.

DRAWINGS

The same part numbers designate the same or similar parts throughout the figures.

DESCRIPTION

Figure 1:
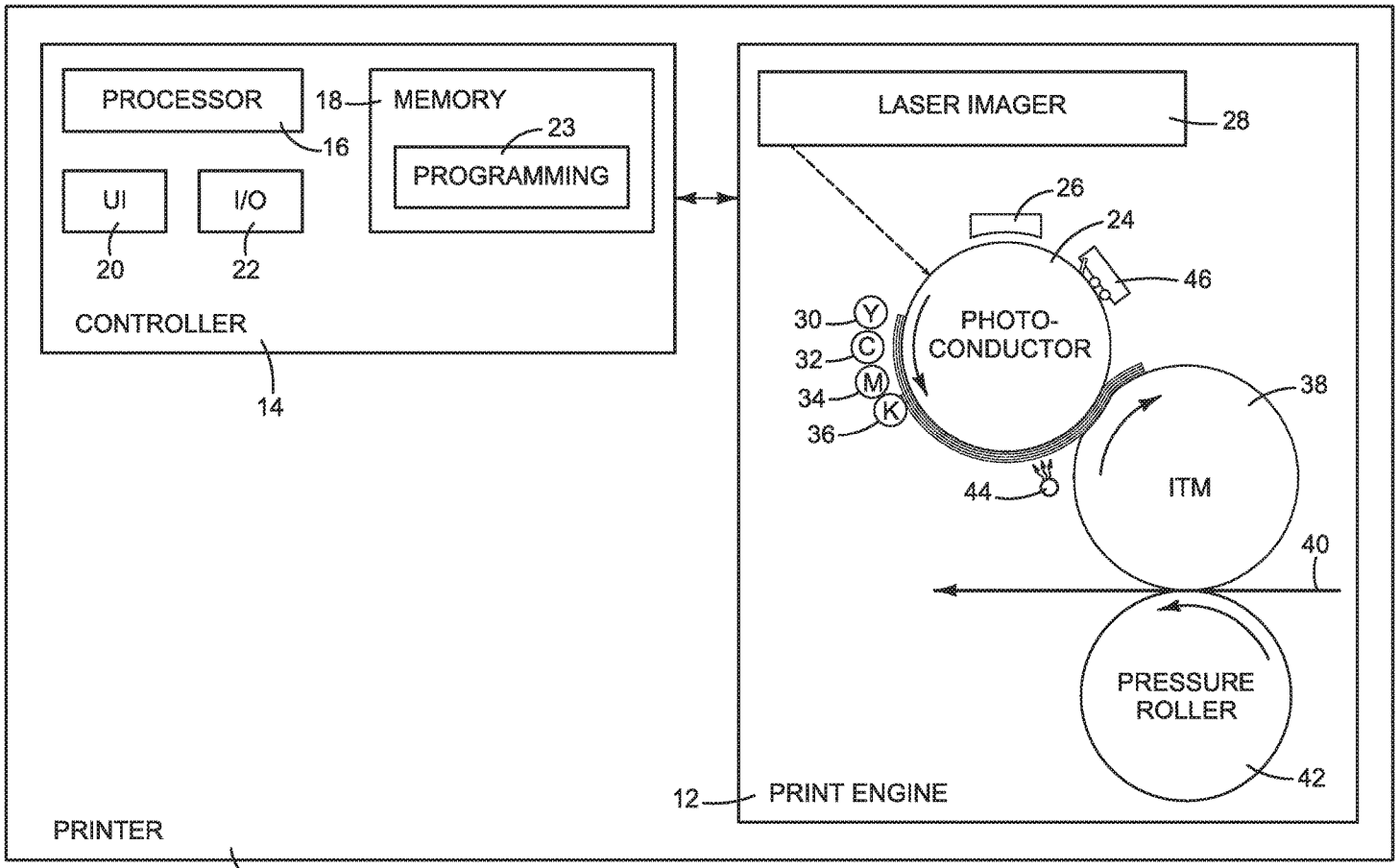
FIG. 1 is a block diagram illustrating one example of an LEP printer configured to apply the color ink layers to the photoconductor one on top of another and then transfer a single, composite ink layer to the intermediate transfer member and then to the print substrate.

A new LEP printing process has been developed in which the color ink layers are applied successively to the photoconductor one on top of another and then transferred to the intermediate transfer member (ITM) together as a single, composite ink image. In one example of the new process, the latent image for each successive ink layer is formed partly on the photoconductor and partly on the prior ink layer. Then, when the latent image is developed into an ink image, the ink will adhere to the prior, underlying ink as well as to the photoconductor. In one specific implementation, the prior ink layer on the photoconductor is separated into an inner region of mostly toner particles along the photoconductor and an outer region of mostly carrier liquid. The latent image for the next ink is formed by simultaneously charging the region of mostly carrier liquid as well as the photoconductor and then discharging select areas of both in a pattern corresponding to the desired image for the next ink.

Currently, most LEP printers use a process in which each of the color ink layers developed on the photoconductor is transferred individually from the photoconductor to the ITM and then from the ITM to the print substrate. Where four colors are used, CMYK (cyan, magenta, yellow and black) for example, this conventional process is sometimes referred to as a "4 shot" process or a "1-1-4" process because the four colors are transferred individually from the photoconductor to the ITM and from the ITM to the print substrate where they are collected successively one on top of another to form the desired image.

One of the challenges implementing a 1-1-4 process is accurately aligning each successive ink layer to the underlying layer(s). The alignment of one ink layer to another ink layer is commonly referred to as "color plane registration." A "1-4-1" process in which the ink layers are collected on the ITM and transferred to the print substrate as a single, composite has been used to help minimize color plane registration errors. In a 1-4-1 process, however, the underlying ink layers tend to dry out on the heated ITM waiting for all four layers to accumulate, causing poor transferability and inadequate adhesion to the print substrate. Optimizing the ITM to mitigate excessive drying while still maintaining good color plane registration can degrade color quality.

Examples of the new "4-1-1" LEP process help minimize color plane registration errors while maintaining good ink transferability and adhesion with high color quality. Ink layers are developed one on top of the other on the relatively cool photoconductor to avoid ink dry-out. The multi-layer composite developed on the photoconductor is transferred to the hot ITM where the carrier liquid evaporates and the toner particles fuse. With the new process, the ITM may be optimized for good ink transferability and adhesion alone without the need to also maintain good color plane registration and the attendant risk to color quality. Also, after transferring the ink to the print substrate, the ITM is allowed to rest three ink cycles before receiving the next transfer from the photoconductor, which helps the ITM recover from electrical or physical artifacts that cause unwanted ITM memories.

The examples shown in the figures and described herein illustrate but do not limit the invention which is defined in the Claims following this Description.

As used in this document, "LEP ink" means a liquid that includes toner particles in a carrier liquid suitable for electro-photographic printing.

FIG. 1 illustrates one example of an LEP printer 10 configured to apply the color ink layers to the photoconductor one on top of another and then transfer a single, composite ink layer to the intermediate transfer member. Referring to FIG. 1, printer 10 includes a print engine 12 and a controller 14 operatively coupled to print engine 12. Controller 14 represents generally the programming, processor and associated memory, and the electronic circuitry and components needed to control the operative elements of printer 10, including the elements of print engine 12 described below. An LEP printer controller 14 may include multiple controller and microcontroller components and usually will include one or more processors 16 and associated memory(ies) 18, a user interface (UI) 20, an input output device (I/O) 22 for communicating with external devices, and programming 23 for controlling printer functions. Processors 16 may include, for example, general purpose processors, microprocessors, and application specific integrated circuits (ASICs). Memory(ies) 18 may include, for example, hard disk drives, random access memory (RAM), and read only memory (ROM). Programming 23 may include, for example, software, firmware, and hardware (e.g., ASICs). Although print engine 12 and controller 14 are shown in different blocks in FIG. 1, some of the control elements of controller 14 may reside in print engine 12, for example close to the print engine components they control or power.

During printing in LEP printer 10, a uniform electric charge is applied to a photoconductor 24, the photosensitive outer surface of a cylindrical drum for example, by a charging device 26 configured to charge photoconductor 24 from a distance. Because multiple ink layers are collected on photoconductor 24, charging device 26 is configured to charge photoconductor 24 and the underlying ink layers without damaging the ink. A scorotron or floating charge roller, for example, may be used for charging device 26. A scanning laser or other suitable photoimaging device 28 illuminates selected areas on photoconductor 24 and on the underlying ink layers to discharge the photoconductor and the ink in a pattern corresponding to the desired ink image. A thin layer of LEP ink is applied to the patterned photoconductor/ink using one of the developers 30, 32, 34, 36. Each developer 30-36 is a typically complex mechanism supplying a different color ink. In the example shown, four developers 30-36 supply yellow, cyan, magenta and black ink to photoconductor 24. The latent image on photoconductor 24 and on the underlying ink is developed into a visible, ink image through the application of ink that adheres to the charge pattern.

Once all of the ink layers are applied to photoconductor 24, the composite ink image is transferred to an intermediate transfer member (ITM) 38 and then from intermediate transfer member 38 to sheets or a web of print substrate 40 passing between intermediate transfer member 38 and a pressure roller 42. A lamp or other suitable discharging device 44 removes residual charge from photoconductor 24 and ink residue is removed at a cleaning station 46 after the ink image is transferred to intermediate transfer member 38 in preparation for developing the next image on photoconductor 24.

Figure 2:
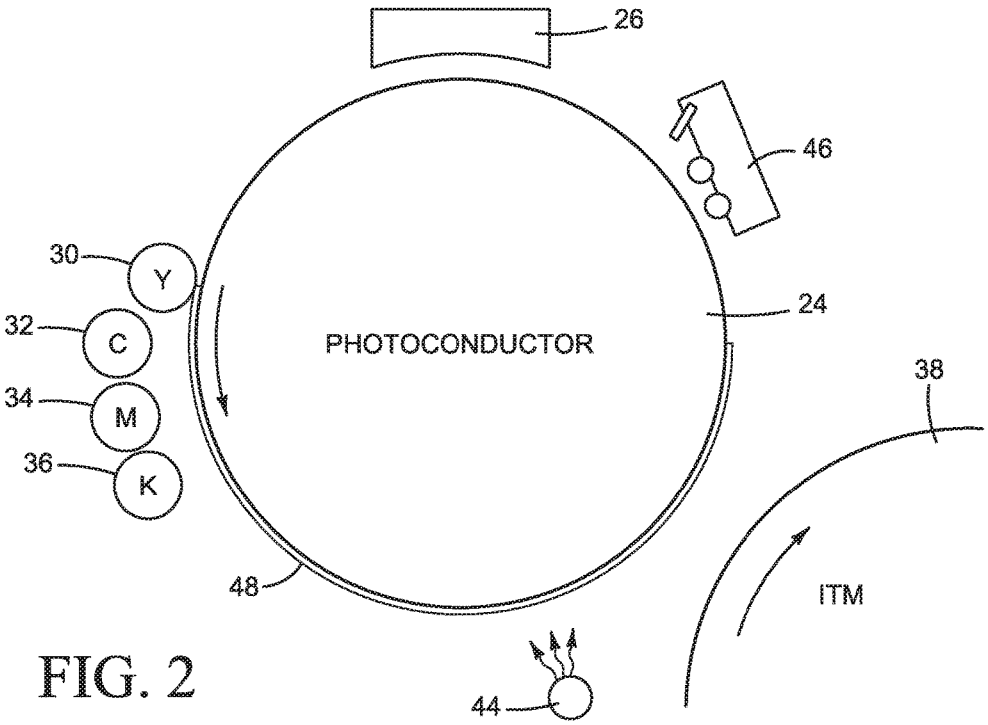
FIG. 2 is a close-up showing the position of the print engine components in the printer of FIG. 1 for applying the first layer of ink to photoconductor.
Figure 3:
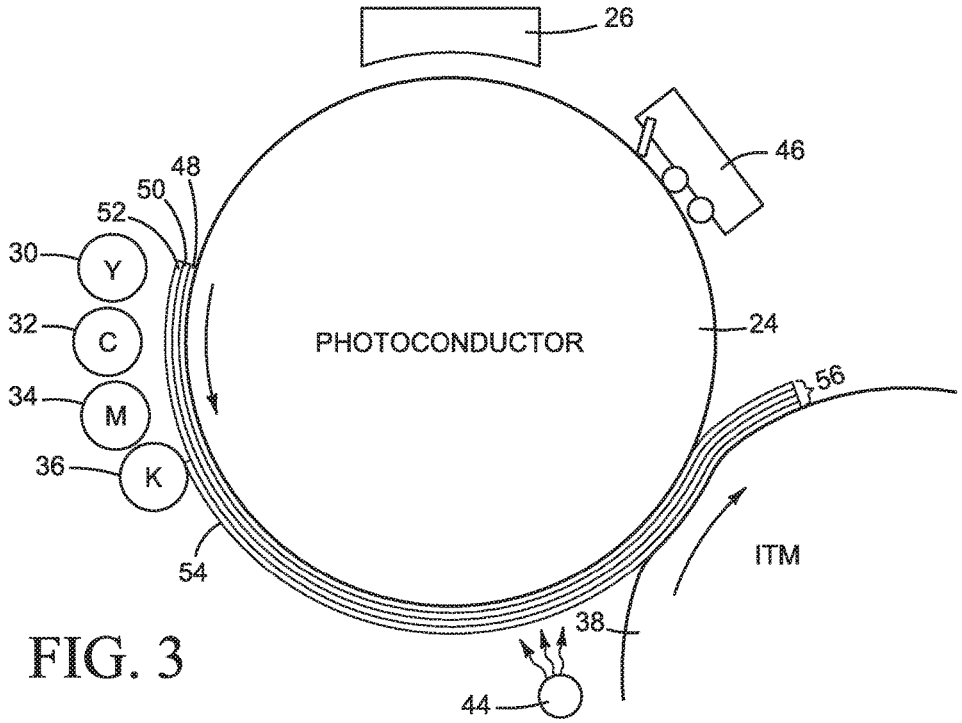
FIG. 3 is a close-up showing the position of the print engine components in the printer of FIG. 1 for transferring a 4-layer ink composite on the photoconductor to the intermediate transfer member.

FIG. 2 is a close-up showing the position of the print engine components for applying the first layer of ink to photoconductor 24. FIG. 3 is a close-up showing the position of the print engine components for transferring the 4-layer composite on photoconductor 24 to intermediate transfer member 38. In FIG. 2, yellow developer 30 is engaged to develop the yellow color plane, applying yellow ink layer 48 to photoconductor 24. The other developers 32, 34, 36 and intermediate transfer member 38 and cleaning station 46 are disengaged from photoconductor 24. In FIG. 3, black developer 36 is engaged to develop the black color plane, applying black ink layer 54 to photoconductor 24 over the magenta, cyan and yellow ink layers 52, 50, and 48, respectively, to form a four layer image composite 56 that is transferred to intermediate member 38. The other developers 30, 32, 34 are disengaged and intermediate member 38 and cleaning station 46 are engaged. The charge pattern for the latent image on photoconductor 24 for each ink layer 50, 52, 54 may include portions formed directly on photoconductor 24 where there is no underlying ink layer 48, 50, or 52 and portions formed on one or more ink layers 48, 50, 52 that underlay the next ink layer 50, 52, 54. For clarity, the thickness of each ink layer 48-54 is greatly exaggerated in the figures. Each ink layer is actually only a few microns thick. Also, the ink layers are not necessarily applied in the YMCK order shown. Other configurations are possible.

Figure 4:
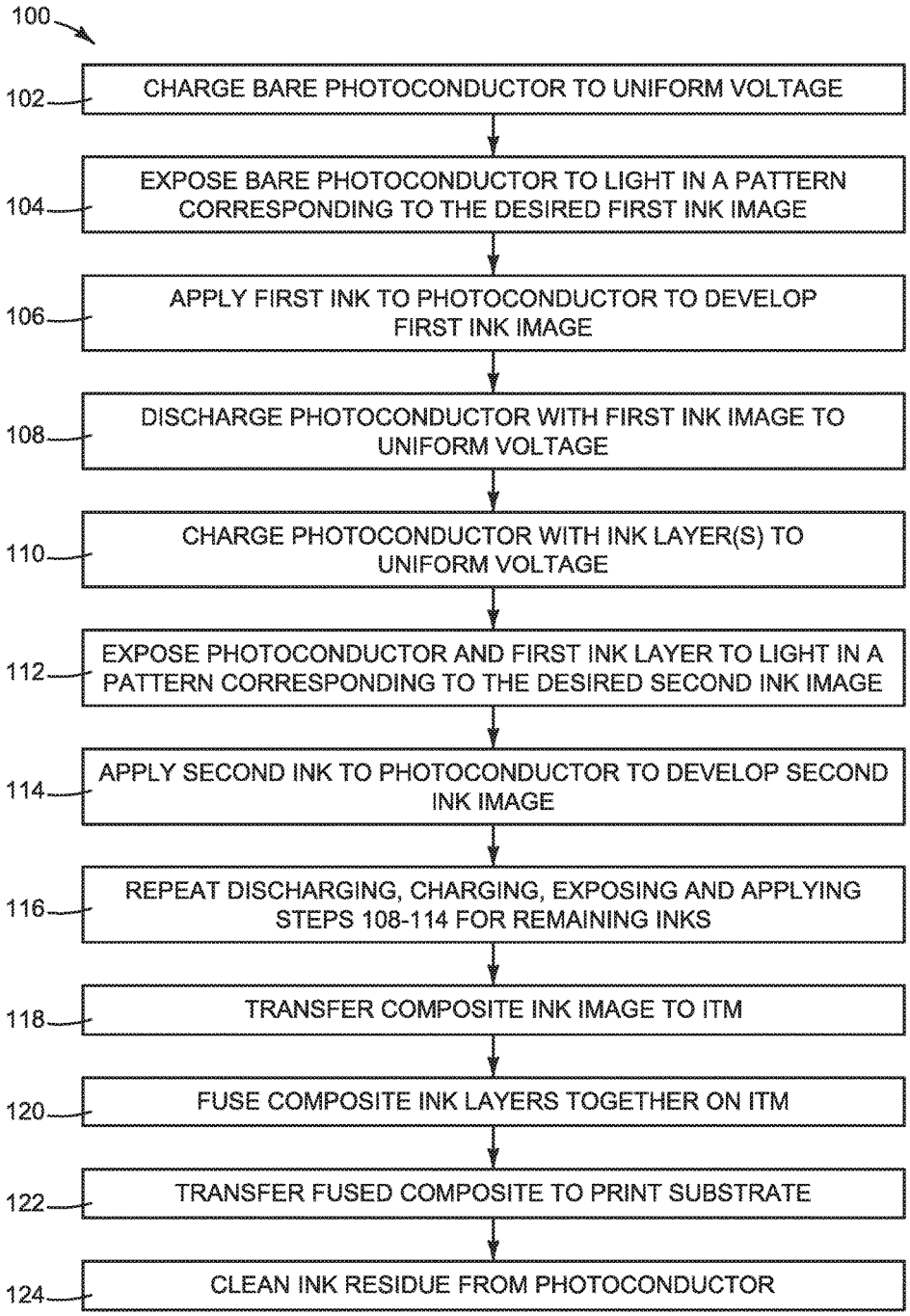
FIG. 4 is a flow diagram illustrating one example of a new, "4-1-1" LEP printing process such as might be implemented in the printer shown in FIG. 1.

FIG. 4 is a flow diagram illustrating one example of a 4-1-1 LEP printing process 100 such as might be implemented in printer 10 shown in FIG. 1. FIGS. 5-13 are close-ups illustrating some of the steps of process 100 implemented in print engine 12 at the direction controller 14 in printer 10. The process is described with reference to the printer components shown in FIGS. 1-3. Referring to FIG. 4, for the first layer of ink, the bare photoconductor 24 is charged to a uniform voltage, about −970V for example, as is passes charging device 26 (step 102). A scorotron, floating charge roller or other charging device 26 that does not have physical contact photoconductor 24 is used to avoid disturbing the ink applied to photoconductor 24.

Figure 5:
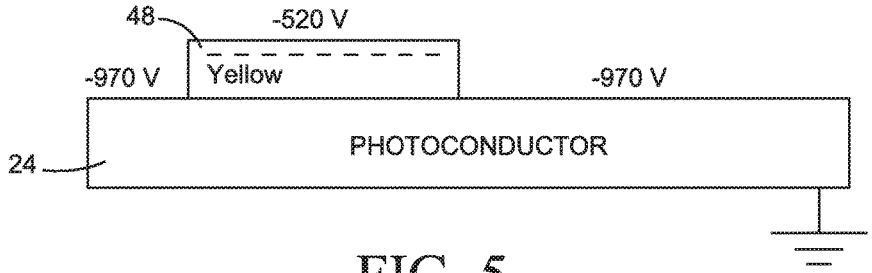
FIGS. 5-13 are close-ups illustrating some of the steps of the printing process of FIG. 4 implemented in a printer such as that shown in FIG. 1.

The uniformly charged photoconductor 24 is exposed to light, usually visible light, with a scanning laser or other suitable photoimaging device 28 to discharge select areas of photoconductor 24 to a lower voltage, about −70V for example, in a pattern corresponding to the desired image for the first color ink (step 104). Currently, yellow LEP ink is the most transparent and black LEP ink the least transparent to the imaging and discharge lights. Thus, it may be desirable in some implementations to apply yellow ink first and black ink last to photoconductor 24. Ink is applied to photoconductor 24 at developer 30 to "develop" the latent, discharged image on photoconductor 24 into a visible, first ink image 48 as shown in FIG. 5 (step 106). Developer 30 is held at a voltage between that of the charged and discharged areas of photoconductor 24, about −520V for example, so that the charged LEP ink adheres to the lower voltage, discharged areas of photoconductor 24 and is repelled from the higher voltage areas of photoconductor 24. This first visible, ink image is represented by yellow ink layer 48 in the figures.

Figure 6:
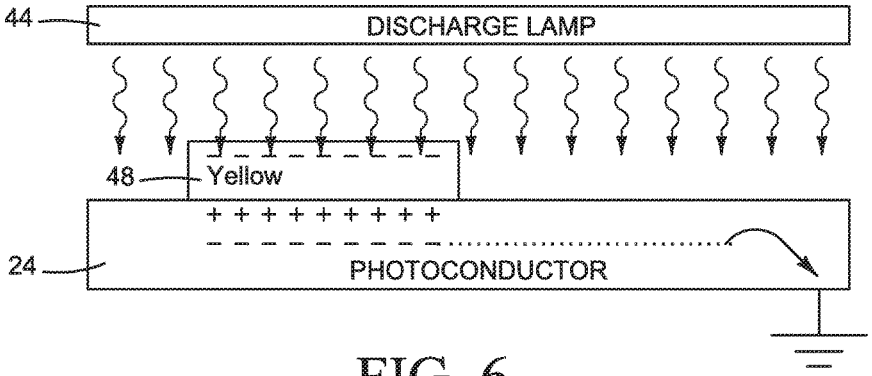

Photoconductor 24 and yellow ink 48 are discharged to a uniform voltage, about −70V for example, as they pass a lamp or other suitable discharging device 44, as shown in FIG. 6 (step 108). The wavelength of light from discharging device 44 should be transparent to each color LEP ink. For example, red and infrared light from a discharging lamp 44 is transparent to conventional LEP inks, although the degree of transparency may vary between inks.

Figure 7:
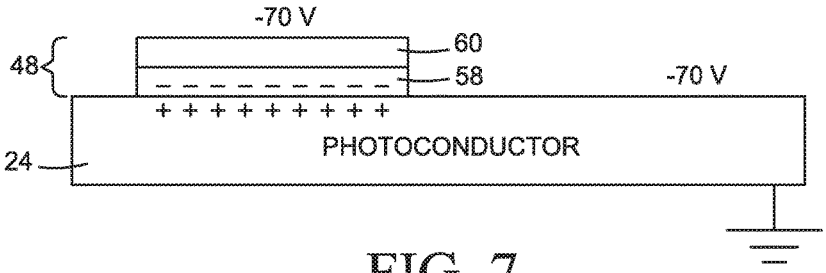

The infrared light photons create electron-hole pairs in photoconductor 24. Positive holes are attracted to the ink's negatively charged toner particles which become anchored to photoconductor 24, as shown in FIG. 7, separating the ink into two regions—an inner region 58 that is mostly charged toner particles and an outer region 60 that is mostly uncharged carrier liquid. This separation in applying the next, overlying layer of ink without disturbing the charge on the toner particles in the underlying layer of ink, thus maintaining good adhesion throughout the process of forming the multi-ink composite on photoconductor 24.

Figure 8:
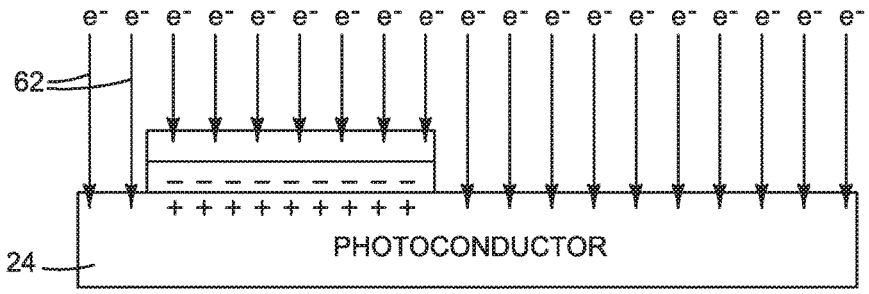
Figure 14:
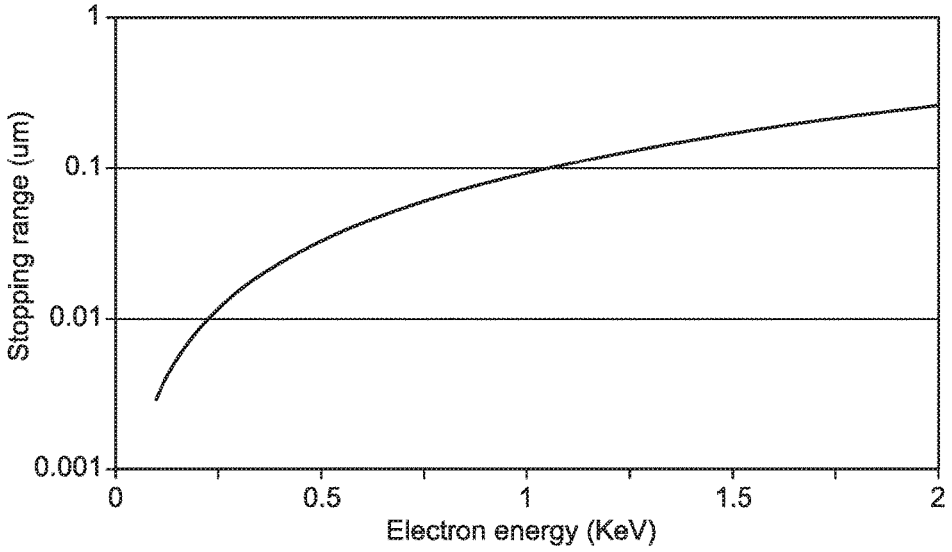
FIG. 14 is a graph illustrating one example of a range of energies for charging electrons to penetrate into but not through an LEP ink carrier liquid.

As shown in FIG. 8, photoconductor 24 and yellow ink 48 are charged to a uniform voltage as they pass charging device 26 (step 110 in FIG. 4). The charging energy of the electrons e is selected to charge only the outer, carrier liquid part 60 of ink layer 48. For example, as shown in the graph of FIG. 14, for a layer 60 of a carrier liquid such as Isopar™ L (a synthetic isoparaffinic hydrocarbon solvent) typically about 1 μm thick with a density of about 0.77 gm/cm$^3$, charging electrons up to about 2 KeV will penetrate into but not through carrier liquid layer 60. Charging electrons with this same energy will also penetrate and charge photoconductor 24, as indicated by arrows 62 in FIG. 8, resulting in the photoconductor charge configuration shown in FIG. 9.

Figure 9:
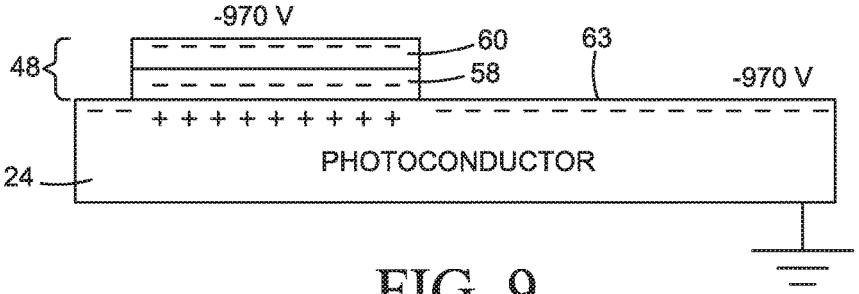
Figure 10:
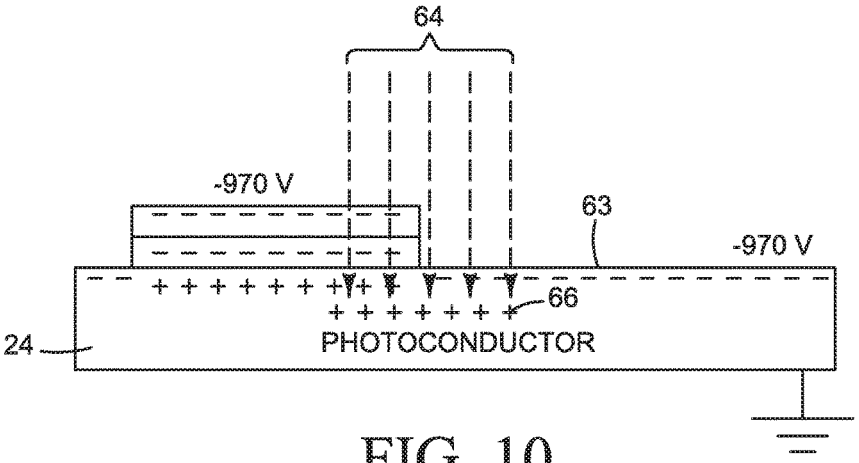
Figure 11:
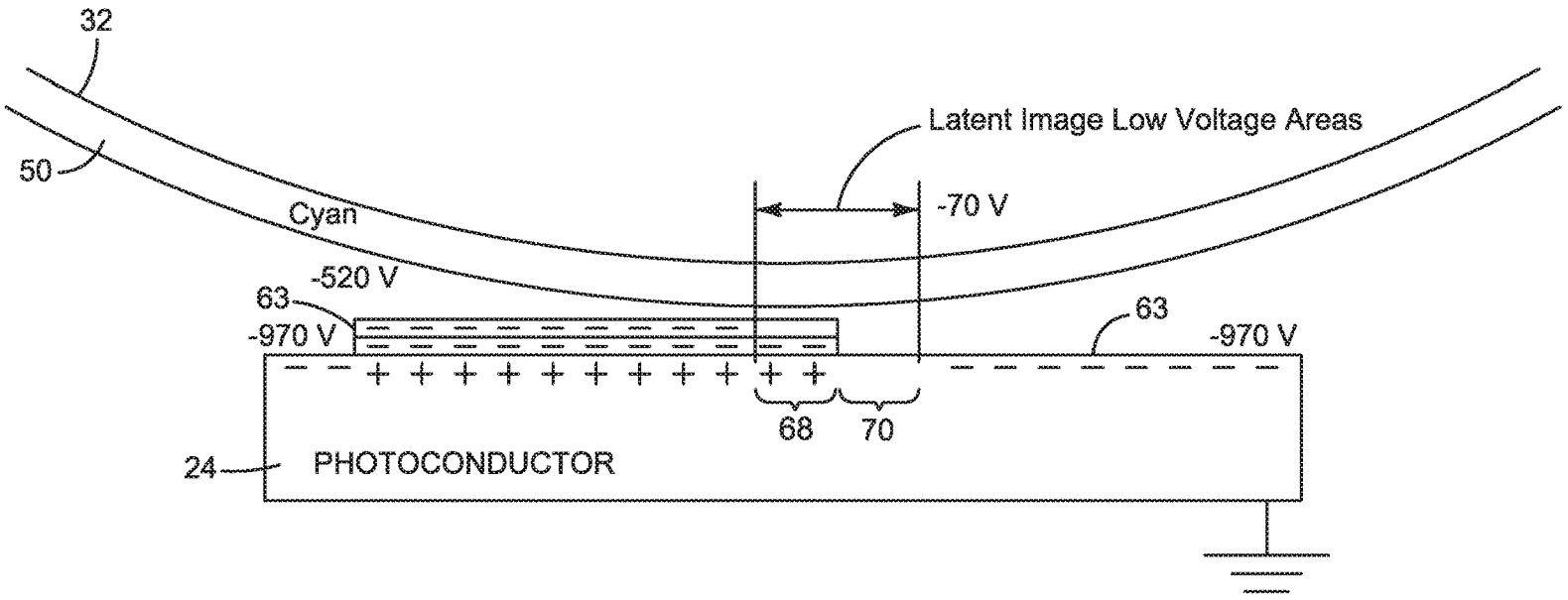

The regions of photoconductor 24 and ink image 48 charged to a higher voltage is indicated by −970V region(s) 63 in FIGS. 9-11.

As shown in FIG. 10, the uniformly charged photoconductor 24 and ink layer 48 is again exposed to imaging light 64 to discharge select areas to a lower voltage in a pattern corresponding to the desired image for the second color ink (step 112). Imaging light 64 produces positive charges 66 in photoconductor 24 that neutralize negative charges in ink carrier liquid, outer layer 60 (as well as the negative charges in photoconductor 24 in the area exposed to light 64). The resulting photoconductor charge configuration is shown in FIG. 11 in which the charge pattern includes higher voltage regions 63 and lower voltage regions 68, 70. Each ink should be sufficiently transparent to imaging light 64 to allow discharging photoconductor 24 and ink outer layer 60 to the desired voltage. Visible imaging light typically used in LEP printing is transparent to conventional LEP inks.

Figure 12:
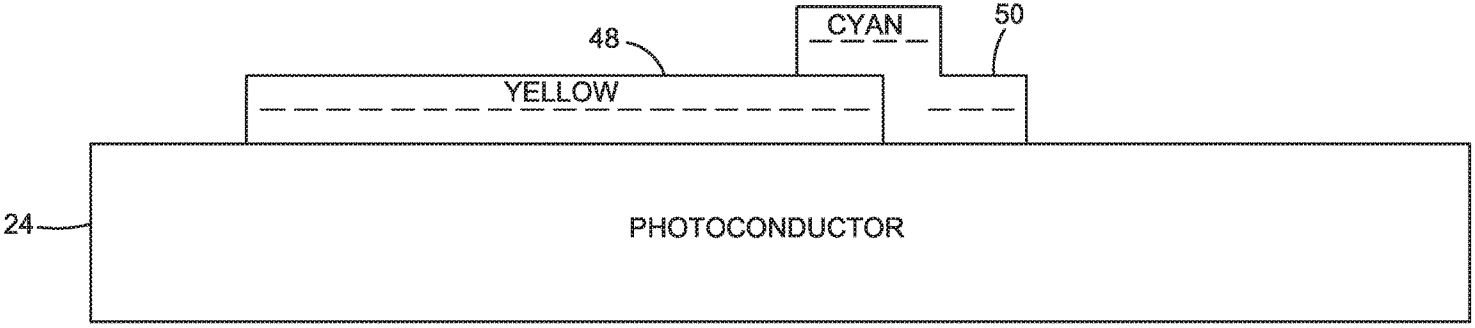

In the example shown in FIG. 11, photoconductor 24 is exposed to imaging light 64 in a pattern for the second ink image that includes parts 68 overlapping yellow ink layer 48 over photoconductor 24 and parts 70 directly on photoconductor 24. The second ink is applied to photoconductor 24 at developer 32 to develop the second latent image on photoconductor 24 into a visible, second ink image (step 114). The second visible, ink image is represented in FIG. 12 by yellow ink layer 48 and cyan ink layer 50 in FIG. 12. Although the yellow and cyan inks are shown as distinct layers in FIG. 12 (as are all four colors in FIG. 13), the successive ink layers mix together where they overlap one another. Separation also occurs in the mixed ink overlap areas during discharge with an inner region of charged toner particles close to photoconductor 24 and an outer region of carrier fluid, similar to that shown for a single layer of ink in FIGS. 7-11.

Referring again to FIG. 11, the higher voltage of the ink carrier liquid outside the latent image areas 68, 70 repels cyan ink 50 and helps keep yellow ink 48 on photoconductor 24 from moving toward cyan developer 32, thus minimizing or eliminating the "back transfer" of ink from photoconductor 24 to a developer 32, 34, 36. In the lower voltage, latent image areas 68, 70 cyan ink moves from developer 32 on to photoconductor 24 and on to the previously developed yellow ink layer 48.

Figure 13:
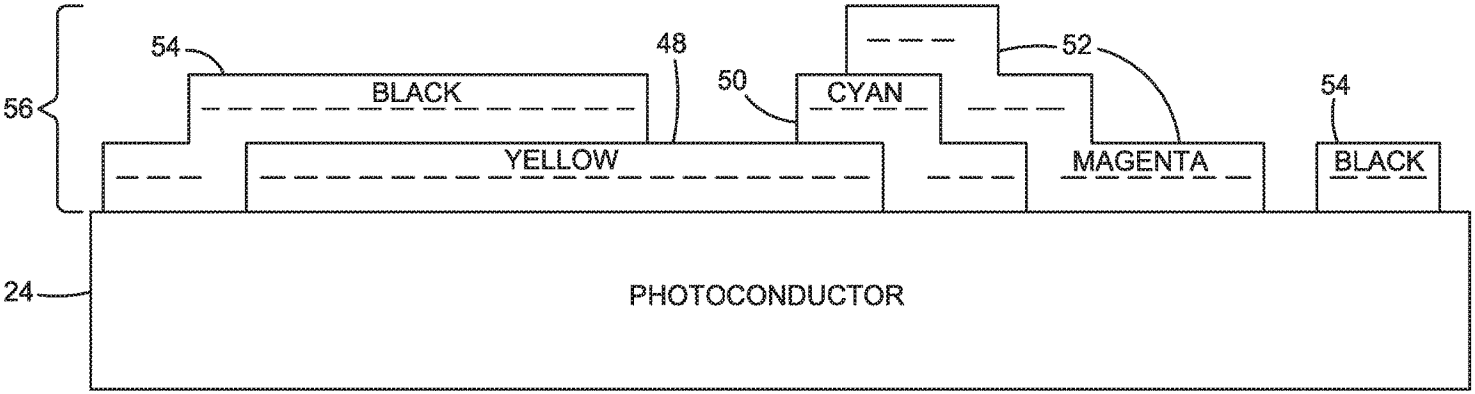

Referring again to FIG. 4, the discharging, charging, exposing and applying steps 108-114 are repeated for each of the other inks (step 116), the magenta and black inks in this example, to form a composite ink image 56 such as that shown in FIGS. 1, 3 and 13. Composite ink image 56 is transferred to the heated intermediate transfer member 38 (step 118), as shown in FIG. 2, where much of the carrier liquid evaporates, leaving a fused, semi-solid composite ink image (step 120) that is pressed on to the cooler print substrate 16 and "frozen" in place at the nip between intermediate transfer member 38 and pressure roller 42 (FIG. 1) (step 122). Any ink residue on photoconductor 24 following the transfer to intermediate transfer member 38 is removed and cleaning station 46 in preparation for printing the next image (step 124).

"A" and "an" as used in the Claims means one or more.

As noted at the beginning of this Description, the examples shown in the figures and described above illustrate but do not limit the invention. Other examples may be made and implemented. Therefore, the foregoing description should not be construed to limit the scope of the invention, which is defined in the following claims.

What is claimed is:

1. A printer, comprising:

a photoconductor;

a charging device to charge the photoconductor;

a photoimaging device to form latent images on the photoconductor;

a controller to operate the photoimaging device to discharge select areas of the photoconductor to form a first latent image;

a first developer applying a first ink to the photoconductor to develop the first latent image into a developed first image, the developed first image having an outer region composed predominantly of carrier liquid and an inner region composed predominantly of charged toner particles;

a discharging device to discharge the photoconductor and the outer region of the developed first image, without discharging the inner region of the developed first image, wherein the charging device to then re-charge the photoconductor and the outer region of the developed first image prior to the controller operating the photoimaging device to form a second latent image overlapping at least a part of the developed first image on the photoconductor; and a second developer to develop the second latent image on the photoconductor while the first developed image remains on the photoconductor.

2. The printer of claim 1, further comprising an intermediate member to transfer the developed images to a print substrate.

3. The printer of claim 2, wherein the intermediate member is heated to fuse together the developed first and second developed images to form a fused composite developed image, the intermediate member to transfer the fused composite developed image to the print substrate.

4. The printer of claim 1, wherein the charging device comprises a scorotron or floating charge roller, the printer further comprising four developers, wherein the first developer contains yellow ink and a fourth developer contains black ink.

5. A method of printing, the method comprising:

developing a first latent image on a photoconductor into a developed image, the developed image having an outer region composed predominantly of carrier liquid and an inner region composed predominantly of charged toner particles;

discharging the photoconductor and the outer region of the developed image, without discharging the inner region of the developed image;

charging the outer region of the developed image and the photoconductor;

forming a second latent image on the photoconductor without removing the developed image, the second latent image overlapping at least part of the developed image.

6. The method of claim 5, further comprising:

developing the second latent image;

transferring together the developed images to an intermediate member.

7. The method of claim 6, further comprising fusing together the developed images with heat on the intermediate member.

8. The method of claim 6, further comprising transferring the developed images together from the intermediate member to a print substrate.

9. The method of claim 5, further comprising successively forming and then developing a third and a fourth latent image on the photoconductor, the developed images being stacked on top of each other on the photoconductor.

10. The method of claim 9, further comprising forming the first developed image with yellow ink and forming the fourth developed image with black ink.

11. The method of claim 5, further comprising, for each developed image:

separating ink of that developed image into an inner region of mostly toner particles along the photoconductor and an outer region of mostly carrier liquid;

simultaneously charging the region of mostly carrier liquid and the photoconductor to a higher voltage; and discharging select areas of the region of mostly carrier liquid and the photoconductor to a lower voltage in a pattern corresponding to a next latent image.

12. The method of claim 11, wherein the discharging to form a next latent image comprises exposing select areas of the region of mostly carrier liquid and the photoconductor to visible light.

13. The method of claim 11, wherein the charging comprises exposing the region of mostly carrier liquid and the photoconductor to electrons having an energy sufficient to penetrate the region of mostly carrier liquid and the photoconductor, but not the region of mostly toner particles.

14. The method of claim 13, wherein exposing the region of mostly carrier liquid and the photoconductor to electrons having an energy sufficient to penetrate the region of mostly carrier liquid and the photoconductor but not the region of mostly toner particles comprises exposing the region of mostly carrier liquid and the photoconductor to electrons having an energy of 0.5 KeV to 2.0 KeV.

15. The method of claim 11, wherein separating the ink into an inner region of mostly toner particles along the photoconductor and an outer region of mostly carrier liquid comprises exposing the ink to infrared or red light.

16. A non-transitory memory comprising programming for a processor of a printer, the programming, when executed by the processor, causing a charging device to charge a photoconductor;

a photoimaging device to discharge select areas of the photoconductor to form a first latent image on the photoconductor;

a first developer to develop the first latent image into a developed image, the developed image having an outer region composed predominantly of carrier liquid and an inner region composed predominantly of charged toner particles;

a discharging device to discharge the photoconductor and the outer region of the developed image, without discharging the inner region of the developed image;

the charging device to charge the photoconductor and the outer region of the developed image;

the photoimaging device to discharge select areas of the photoconductor and the outer region of the developed image to form a second latent image, the second latent image at least partially overlapping the developed image on the photoconductor; and a second developer to develop the second latent image.

17. The memory of claim 16, wherein the programming also includes instructions for, after developing the second latent image, repeating:

discharging the photoconductor and the second developed image;

charging the photoconductor and the second developed image;

discharging select areas of the photoconductor and the second developed image to form a third latent image; and operating a third developer to develop the third latent image.

18. The memory of claim 16, wherein the programming also includes instructions for, after developing the third latent image, repeating:

discharging the photoconductor and the third developed image;

charging the photoconductor and the third developed image;

discharging select areas of the photoconductor and the third to form a fourth latent image; and operating a fourth developer to develop the fourth latent image.

19. The memory of claim 16, wherein the programming also includes instructions for transferring the first and second developed images together as a composite image from the photoconductor to an intermediate member.

20. The method of claim 16, wherein the programming also includes instructions for fusing the composite image with heat on the intermediate member and transferring the fused, composite image to a print substrate.

* * * * *